US005716748A

United States Patent [19]

Hasegawa et al.

[11] Patent Number: 5,716,748

[45] Date of Patent: Feb. 10, 1998

[54] DEVELOPER AND FINELY PARTICULATE POLYMER

[75] Inventors: Jun Hasegawa; Katsuhiro Imai; Nobuyasu Ota; Kazunori Shigemori, all of Kanagawa-ken, Japan

[73] Assignee: Nippon Zeon Co., Ltd., Tokyo, Japan

[21] Appl. No.: 686,677

[22] Filed: Jul. 26, 1996

[30] Foreign Application Priority Data

Jul. 28, 1995 [JP] Japan ..... 7-212547
Apr. 15, 1996 [JP] Japan ..... 8-118492

[51] Int. Cl.[6] ..... G03G 9/08

[52] U.S. Cl. ..... 430/110; 430/111

[58] Field of Search ..... 430/110, 111, 430/137

[56] References Cited

U.S. PATENT DOCUMENTS

| | | | |
|---|---|---|---|
| 2,895,847 | 7/1959 | Mayo . | |
| 3,152,012 | 10/1964 | Schaffert . | |
| 3,909,258 | 9/1975 | Kotz . | |
| 4,121,931 | 10/1978 | Nelson . | |
| 4,943,505 | 7/1990 | Aoki et al. | 430/111 |
| 5,077,169 | 12/1991 | Inoue et al. | 430/110 |
| 5,178,984 | 1/1993 | Nagatsuka et al. | 430/110 |

FOREIGN PATENT DOCUMENTS

| | | |
|---|---|---|
| 41-9475 | 5/1966 | Japan . |
| 45-2877 | 1/1970 | Japan . |
| 54-3624 | 2/1979 | Japan . |
| 60-186851 | 9/1985 | Japan . |
| 60-186852 | 9/1985 | Japan . |
| 60-186854 | 9/1985 | Japan . |
| 1 385 966 | 3/1975 | United Kingdom . |

*Primary Examiner*—Christopher D. Rodee
*Attorney, Agent, or Firm*—Armstrong, Westerman, Hattori, McLeland & Naughton

[57] ABSTRACT

The invention provides a developer comprising toner particles and a finely particulate polymer, wherein the finely particulate polymer is a finely particulate polymer of core-shell structure, which has a core part formed of a vinyl aromatic hydrocarbon polymer and a shell part formed of a (meth)acrylic ester polymer, and is obtained by a soap-free emulsion polymerization process. The developer has stable flowability and charging properties. The invention also provides such a finely particulate polymer and a preparation process thereof.

20 Claims, 1 Drawing Sheet

DEVELOPER AND FINELY PARTICULATE POLYMER

FIELD OF THE INVENTION

The present invention relates to a developer suitable for use in developing electrostatic latent images in electrophotography, electrostatic recording, electrostatic printing, etc., and more particularly to a developer having stable flowability and charge properties, and excellent development durability and environmental stability. The present invention also relates to a developer which is strongly charged with negative charge and prevented from lowering its characteristics and properties over a long period of time when used in an electrophotographic development process. The present invention further relates to a finely particulate polymer suitable for use as an abrasive for toners, and a preparation process thereof. The developers according to the present invention are suitable for use, in particular, as non-magnetic one-component developers.

BACKGROUND OF THE INVENTION

In the electrophotographic process and electrostatic recording process, two-component developers composed of toner particles and carrier particles, and one-component developers composed substantially of toner particles alone and making no use of any carrier particles are known as developers for making an electrostatic latent image visible. The toner particles are colored particles which are composed of at least a binder resin and a colorant, and moreover may be added with colloidal silica or the like as a flowability-imparting agent independently of the colored particles.

In the two-component developers, toner particles are generally charged by triboelectrification between the toner particles and the carrier particles, and an electrostatic latent image is made visible by the charged toner particles. The two-component developers are widely used owing to good quality in images developed thereby.

However, the two-component developers involve the following common defects.

(1) Toner particles are triboelectrified by mutual friction between the toner particle and the carrier particles. However, when the two-component developer is used for a long period of time, a film of the toner particles is formed on the surfaces of the carrier particles, so that the toner particles fail to gain sufficient triboelectric charge, resulting in the production of fog and the like.

(2) The toner particles and the carrier particles must be controlled to a mixing ratio within a fixed range. However, when the developer is used for a long period of time, the mixing ratio is changed outside the fixed range, so that the quality of images developed thereby becomes unstable. In addition, it is difficult to control the change in mixing ratio.

(3) The surface of a photoconductor is mechanically damaged by iron powder the surface of which is oxidized, or glass beads, which are both generally used as carrier particles, so that the life of the photoconductor is reduced.

(4) Since the developer must be replaced after it is used for a certain period of time, maintenance cannot be omitted.

(5) Since a large amount of the carrier particles is essential in addition to the toner particles, the miniaturization of apparatus is limited.

Therefore, in recent years, one-component developers, in which any carrier particles are not used, have been developed. Among the one-component developers, there is a magnetic one-component developer containing magnetic powder in toner particles. Various developing processes making use of such a developer have been proposed (for example, U.S. Pat. Nos. 3,909,258 and 4,121,931).

However, the magnetic one-component developer involves the following defects.

(1) Since the magnetic one-component developer contains a large amount of magnetic powder which is low in electric resistance, it is difficult to enhance its charge level, and so it is difficult to electrostatically transfer an image developed with the developer on a photoconductor to a support material such as plain paper. In particular, sufficient performance in transfer cannot be attained under a high-humidity atmosphere.

(2) It is difficult to produce color developers because the magnetic one-component developer contains a large amount of the magnetic powder of a black color, and so the hue of the toner particles becomes black.

(3) Since the magnetic one-component developer contains a large amount of the magnetic powder, its fixing capability is lowered as compared to the two-component developer. As a result, the temperature and pressure of a fixing device must be raised, resulting in increased running cost.

On the other hand, the spotlight of attention has been focused on developing processes making use of a non-magnetic one-component developer because the non-magnetic one-component developer contains no magnetic powder and has high electric resistance. As the developing processes making use of a non-magnetic one-component developer, may be mentioned processes based on the touch-down or impression development which is described in, for example, U.S. Pat. No. 2,895,847 or 3,152,012, or Japanese Patent Publication No. 9475/1966, 2877/1970 or 3624/1979. These processes use, as a non-magnetic one-component developer, toner particles obtained by removing carrier particles from a developer heretofore used in the two-component development system. In the developing process making use of the non-magnetic one-component developer, the toner particles are charged by triboelectrification between the toner particles and a development roller or a development blade in the course of forming a thin film of the toner particles on the development roller, and an electrostatic latent image is made visible by the charged toner particles.

However, the non-magnetic one-component developer involves the following defects.

(1) If the flowability of the non-magnetic one-component developer is low in a developing process making use of the non-magnetic one-component developer, the supply of this developer becomes insufficient, resulting in blurred images and reduced image density.

(2) When the charge properties of the non-magnetic one-component developer are low, fog is liable to occur. More specifically, in the developing process making use of the non-magnetic one-component developer, the toner particles are charged by triboelectrification between the toner particles and a development roller, development blade or the like. Therefore, fog is liable to occur unless the charging capability of the developer is great.

On the contrary, in the developing process making use of the two-component developer, the carrier particles such as iron powder or the like can be forcedly moved by the magnetism of a magnetic roller. Therefore, the lowered flowability of toner particles scarcely affects a failure in the supply of the developer. Similarly, the developer itself can be forcedly moved by the magnetic roller even in the magnetic one-component developer. Therefore, a failure in the supply of the developer scarcely becomes a problem. Besides, in the developing process making use of the two-component developer or magnetic one-component developer, the developer can be charged by forcedly stirring it by magnetic force.

In the developing process making use of the non-magnetic one-component developer, the toner particles are required to have excellent flowability and stable triboelectrifying ability, prevent the production of fog on any photoconductor and the lowering of image density over a long period of time, and permit high-quality printing. The poor flowability of the toner particles results in a failure to supply the developer, or a failure to clean away the toner particles to leave the developer on a photoconductor, so that the production of fog or a toner-filming phenomenon may occur. In order to improve the flowability of toner particles, it has heretofore been adopted to independently (externally) add hydrophobic fine particles, for example, inorganic fine particles such as silica or organic fine particles such as fine particles of polytetrafluoroethylene or polystyrene, to the toner particles. However, the conventional inorganic or organic fine particles have not sufficiently satisfied charge properties, flowability, print quality and the like.

For example, the average particle size of silica is 5–100 nm and is very small compared with the average particle size of the toner particles, and its hardness is high. Therefore, it is easily embedded in the surfaces of the toner particles by friction between the toner particles and a development roller, development blade or the like. As a result, such a developer is difficult to keep its good properties such as charge properties and flowability over a long period of time. When inorganic fine particles having an average particle size of about 0.1–2 μm are mixed into the toner particles, it is avoidable for the inorganic fine particles to be embedded in the surfaces of the toner particles by the friction. However, such fine particles involve another problem that the surfaces of the photoconductor and the development roller are damaged by the inorganic fine particles adhered to the surfaces of the toner particles, resulting in deterioration of print quality.

Besides, the conventionally known developers in which the inorganic or organic fine particles are mixed into the toner particles can prevent the adhesion of the toner particles to the surface of the photoconductor to enhance cleaning ability. However, such a developer has involved a problem that the triboelectrifying capability of the toner particles is lowered, and so image density is lowered, and fog is produced when the developer is used over a long period of time.

There have heretofore been proposed developers in which fine powder of an acrylic polymer, an acrylic/styrene copolymer or the like having an average particle size smaller than that of toner particles is mixed as organic fine particles into the toner particles (Japanese Patent Application Laid-Open Nos. 186851/1985, 186852/1985 and 186854/1985). These polymeric fine powders have an average particle size of 0.005–5 μm, preferably 0.1–2 μm. It is said that the developer obtained by mixing this powder can prevent a cleaning failure without damaging the photoconductor and the development roller, and the life of the developer can be prolonged. However, an investigation by the present inventors has revealed that the method in which such fine polymer powder is mixed into the toner particles does not always satisfy the ability to impart charge properties to the resulting developer.

OBJECTS AND SUMMARY OF THE INVENTION

It is an object of the present invention to provide a developer having stable flowability and charge properties, and excellent development durability and environmental stability.

Another object of the present invention is to provide a non-magnetic one-component developer which has excellent flowability and cleaning ability, retains stable flowability and charge properties over a long period of time, and prevents the lowering of image density and the production of fog on a photoconductor.

A further object of the present invention is to provide a finely particulate polymer which is suitable for use as an abrasive for toner particles and permits the provision of a developer having the above-described characteristics and properties.

The present inventors have carried out an extensive investigation with a view toward overcoming the above-mentioned problems involved in the prior art. As a result, it has been found that in a developer in which a finely particulate polymer is mixed into toner particles, the use of a finely particulate polymer of core-shell structure, which has a core part formed of a vinyl aromatic hydrocarbon polymer and a shell part formed of a (meth)acrylic ester polymer, and is obtained by a soap-free emulsion polymerization process, as said finely particulate polymer permits the achievement of the above objects.

The average particle size of the finely particulate polymer useful in the practice of the present invention is generally made smaller than that of the toner particles with a view toward causing it to also act as an abrasive for the toner particles. The finely particulate polymer has little dependence of charge properties on humidity because it contains no residual emulsifier and besides possesses high charging properties attributable to the core-shell structure. Since the developer according to the present invention contains the organic fine particles of this core-shell structure, its charge properties are improved and stabilized over a long period of time. The developer according to the present invention is evenly and strongly charged with negative charge to prevent the lowering of its properties.

When not only the finely particulate polymer but also inorganic fine particles are mixed into toner particles, the resulting developer can retain good flowability over a long period of time. In particular, when inorganic fine particles having an average particle size of 5–20 nm in terms of primary particles and other inorganic fine particles having an average particle size of 30–500 nm in terms of primary particles are used in combination, embedding of the inorganic fine particles into the surfaces of the toner particles by friction between the toner particles and a development roller, development blade or the like is reduced, and so the flowability of the developer can be kept at high level over a long period of time. Further, it has been found that when inorganic fine particles (for example, finely particulate silica) treated with a treatment chemical such as hexamethyldisilazane or octylsilane are used in combination with the toner particles, changes in charge level by friction between the toner particles and the development roller, development blade or the like due to environmental changes such as changes of temperature and humidity become slight. The present invention has been led to completion on the basis of these findings.

According to the present invention, there is thus provided a developer comprising toner particles and a finely particulate polymer, wherein the finely particulate polymer is a finely particulate polymer of core-shell structure, which has a core part formed of a vinyl aromatic hydrocarbon polymer and a shell part formed of a (meth)acrylic ester polymer, and is obtained by a soap-free emulsion polymerization process.

According to the present invention, there is also provided a developer obtained by incorporating inorganic fine particles together with the above finely particulate polymer into toner particles.

According to the present invention, there is further provided a finely particulate polymer of core-shell structure, which has a core part formed of a vinyl aromatic hydrocarbon polymer and a shell part formed of a (meth)acrylic ester polymer, and is obtained by a soap-free emulsion polymerization process.

DETAILED DESCRIPTION OF THE INVENTION

Figure 1:
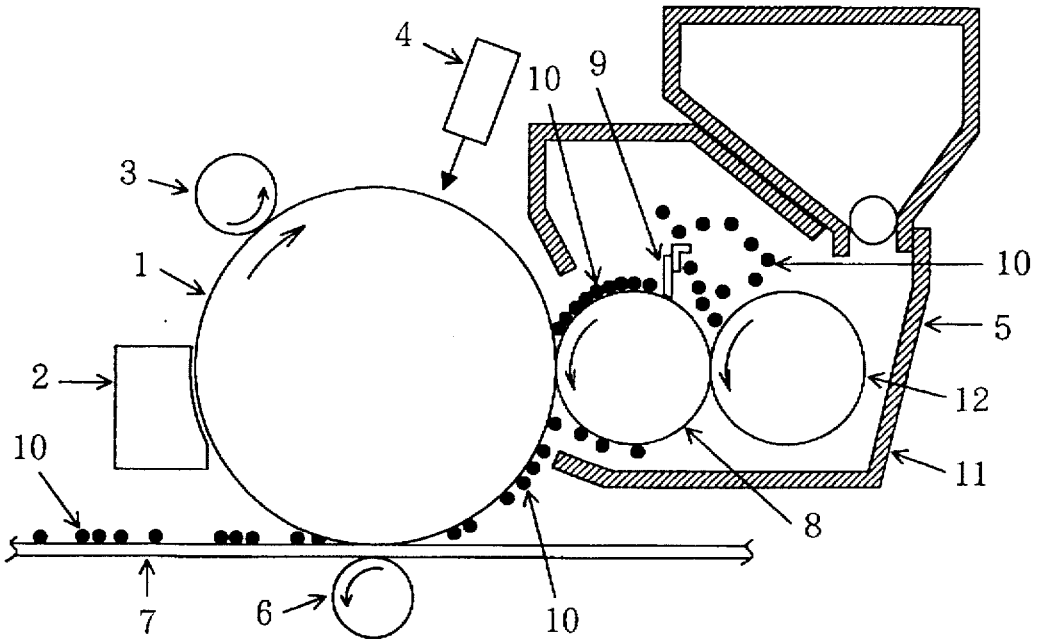
FIG. 1 is a schematic cross-sectional view illustrating an example of an image-forming apparatus to which a developer according to the present invention is applied, and a developing device containing the developer therein.

Finely particulate polymer:

The finely particulate polymer useful in the practice of the present invention is that having a specific core-shell structure and prepared in an emulsion polymerization system making no use of any emulsifier (by a soap-free emulsion polymerization process). The present inventors have found that when a finely particulate polymer has a core-shell structure, and the core part and shell part thereof have different dielectric constants from each other, the charge level of the finely particulate polymer is enhanced, and a developer which retains stable charge properties over a long period of time is provided when the polymer is mixed into toner particles though the reason for that is unknown. The finely particulate polymer of core-shell structure in the present invention means a finely particulate polymer having a structure that the surface of a fine polymer particle forming a core is covered with a polymer forming a shell.

Examples of a vinyl aromatic hydrocarbon monomer (monomer for core) used in forming the core part of the finely particulate polymer, which is formed of the vinyl aromatic hydrocarbon polymer, include styrene, p-methylstyrene, α-methylstyrene and halogenated styrene derivatives. These monomers may be used either singly or in any combination thereof.

Examples of a (meth)acrylic ester monomer (monomer for shell) used in forming the shell part of the finely particulate polymer, which is formed of a (meth)acrylic ester polymer, include (meth)acrylic esters such as methyl (meth) acrylate, ethyl (meth) acrylate, butyl (meth)acrylate, 2-ethylhexyl (meth)acrylate, lauryl (meth)acrylate and glycidyl (meth)acrylate.

In the present invention, the finely particulate polymer of core-shell structure is prepared by a soap-free emulsion polymerization process. In the common emulsion polymerization process, a monomer insoluble in a medium such as water is emulsified with a surfactant (emulsifier) and polymerized using an initiator soluble in the medium such as water. In order to emulsify a hydrophobic monomer such as, for example, styrene, in water, an anionic surfactant such as the sulfate of a higher alcohol or an alkylsulfonic acid salt, or a nonionic surfactant such as an alkyl ether of polyethylene oxide is used as the emulsifier. Water-soluble potassium persulfate, ammonium persulfate, redox initiator or the like is used as the initiator.

On the other hand, any of ordinary emulsifiers such as anionic, cationic and nonionic surfactants is not used in the soap-free emulsion polymerization process. For example, a process in which a reactive emulsifier is used, in which the persulfate of a hydrophilic monomer is used as an initiator, in which an ionic or nonionic water-soluble monomer is copolymerized, in which a water-soluble polymer or oligomer is caused to coexist, in which a decomposable emulsifier is used, or in which a crosslinking emulsifier is used, is adopted. These soap-free emulsion polymerization processes are processes well known in the art. The soap-free emulsion polymerization process in the present invention is not limited to a specific process.

In the soap-free emulsion polymerization for the vinyl aromatic hydrocarbon polymer forming the core part in the present invention, it is preferable to use sodium styrenesulfonate or potassium styrenesulfonate (i.e., a styrenesulfonic acid salt) together with the vinyl aromatic hydrocarbon monomer. When polymerization is performed by the soap-free emulsion polymerization process, some charge-imparting agent is necessary for imparting electric repulsive force to surely retain the colloidal stability of particles. As this charge-imparting agent, it is preferable to use sodium styrenesulfonate or potassium styrenesulfonate. It is desirable that sodium styrenesulfonate or potassium styrenesulfonate be used in a proportion of generally 0.01–20 parts by weight, preferably 0.05–10 parts by weight per 100 parts by weight of the vinyl aromatic hydrocarbon monomer.

In the present invention, any initiators heretofore in use may be employed as the water-soluble initiator. Among these, water-soluble azo catalysts are particularly preferred. Examples of the water-soluble azo catalysts include 2,2'-azobis(2-amidinopropane) dihydrochloride, 4,4'-azobis(4-cyanovaleric acid), 2,2'-azobis[2-(5-methyl-2-imidazolidin-2-yl)propane] dihydrochloride, 2,2'-azobis[2-methyl-N-(1,1-bis(hydroxymethyl)-2-hydroxyethyl)propionamide] and 2,2'-azobis[2-methyl-N-(2-hydroxyethyl)propionamide].

Any conditions for the conventional soap-free emulsion polymerization process may be adopted as polymerization conditions. The concentration of the monomers is generally 3–50 wt. %, preferably 5–20 wt. %. The reaction temperature is generally 5°–95° C.

In order to obtain the finely particulate polymer of core-shell structure, there are, for example, processes in which after a monomer for the core is polymerized, a monomer for the shell is added in the course of the reaction to form a polymer for the shell, and in which a polymer for the shell is subjected to phase separation in the course of the reaction to form a core-shell structure. However, the process in which the monomer for the shell is added in the course of the reaction of the monomer for the core allows a wider latitude in the selection of the monomers. A method for adding the monomer for the shell may be either blanket addition or sequential addition. In order to form a complete core-shell structure, it is preferable to add the monomer for the shell at the time the conversion of the monomer for the core to the polymer reaches at least 90%.

The finely particulate polymer obtained by the soap-free emulsion polymerization process may preferably be purified by filtration through a membrane such as an ultrafilter or ceramic filter, centrifugation and/or the like as needed. In order to add the finely particulate polymer to the toner particles, it is preferable to conduct a powder-forming treatment as a post treatment after the polymerization. A commercially-available dryer may be used for this treatment. Examples of the commercially-available dryer include a continuous flash jet dryer (manufactured by SEISHIN ENTERPRISE CO., LTD.).

A weight ratio of the core part to the shell part is generally 5:95 to 95:5, preferably 10:90 to 90:10. If the weight ratio is outside this range, the effect of the core-shell structure becomes substantially lessened, so that difficulty is encountered on the achievement of the desired objects. The arrangement of the vinyl aromatic hydrocarbon polymer and the (meth)acrylic ester polymer as the core part and the shell part, respectively, permits the provision of a finely particulate polymer strongly charged with negative charge.

The finely particulate polymer according to the present invention has high charge properties attributable to the core-shell structure in addition to merits of (1) being completely spherical particles, (2) being particles having an extremely narrow particle size distribution, (3) having the suitable and desired particle size and (4) containing no residual emulsifier. Therefore, when the polymer is mixed into the toner particles, the charge properties of the toner particles can be stably retained over a long period of time, and so a developer having excellent development durability can be obtained.

The finely particulate polymer of core-shell structure according to the present invention has an average particle size smaller than that of the toner particles. The weight average particle size of the finely particulate polymer is generally 0.005–5 μm, preferably 0.1–2 μm. If the weight average particle size of the finely particulate polymer is too great, the adhesion of the polymer to the toner particles becomes weak, so that the fine particulate polymer tends to separate from the toner particles, resulting in a developer having insufficient development durability. If the weight average particle size of the finely particulate polymer is too small on the other hand, the charge properties of the finely particulate polymer are deteriorated though the reason for that is unknown, so that the durability of the resulting developer may be lowered in some cases. The weight average particle size of the finely particulate polymer is a value measured by the light-scattering method. Since the average particle size of the finely particulate polymer is proper in size, the polymer also acts as an abrasive for the toner particles and is useful for polishing away the toner particles adhered to a photoconductor or the like.

The finely particulate polymer is mixed in a proportion of generally 0.01–10 parts by weight, preferably 0.05–5 parts by weight, more preferably 0.1–2 parts by weight per 100 parts by weight of the toner particles. If the proportion is too low, the effect of the finely particulate polymer mixed becomes little. If the proportion is too high on the other hand, the effect is saturated.

Inorganic fine particles:

In order to improve the flowability and triboelectrification properties of the toner particles and enhance the transferring ability thereof, inorganic fine particles may be incorporated together with the finely particulate polymer into the developer according to the present invention. The inorganic fine particles also act as an abrasive for the toner particles and hence can prevent the formation of a toner film on a photoconductor so as to enhance the transferring ability of the toner particles. Examples of the inorganic fine particles useful in the practice of the present invention include fine particles of metal oxides such as silica, titania, alumina, calcium oxide, magnesium oxide, barium oxide, zinc oxide and tin oxide, and those obtained by subjecting the surfaces of the fine particles of these metal oxides to a hydrophobicity-imparting treatment. In particular, the inorganic fine particles subjected to the hydrophobicity-imparting treatment with a hydrophobicity-imparting agent are improved in moisture resistance and hence can provide a stably flowing effect even in a high-humidity atmosphere. The proportion of the inorganic fine particles to be mixed is generally 0.2–10 parts by weight, preferably 0.4–8 parts by weight, more preferably 0.6–4 parts by weight per 100 parts by weight of the toner particles. If the proportion is too low, the degree of improvement becomes little. If the proportion is too high on the other hand, the triboelectrification properties of the toner particles with a development roller, development blade or the like are lowered, resulting in a developer liable to produce fog.

As the inorganic fine particles, there may be used those having an average particle size of 5–500 nm in terms of primary particles. The term "primary particles" as used in the present invention means particles in a state separated into individual unit particles. The average particle size thereof can be found from a photographic image by a transmission electron microscope (TEM). In the present invention, it is preferable to use inorganic fine particles having an average particle size of 5–20 nm in terms of primary particles and/or other inorganic fine particles having an average particle size of 30–500 nm in terms of primary particles. It is more preferable to use both particles in combination. It is most preferable to use both particles subjected to the hydrophobicity-imparting treatment in combination.

The inorganic fine particles smaller in particle size are those having an average particle size of 5–20 nm, preferably 7–17 nm in terms of primary particles. If the average particle size of the inorganic fine particles of this kind is smaller than 5 nm, the inorganic fine particles become liable to be embedded in the toner particles, so that the flowability of the toner particles is deteriorated as image formation is conducted repeatedly. If the average particle size exceeds 20 nm, the flowability of the toner particles may become insufficient in some cases. The inorganic fine particles smaller in particle size is used in a proportion of generally 0.1–5 parts by weight, preferably 0.2–4 parts by weight, more preferably 0.3–2 parts by weight per 100 parts by weight of the toner particles. If the proportion is too low, it is difficult to impart sufficient flowability to the toner particles, resulting in a developer liable to reduce image density and produce fog. If the proportion is too high on the other hand, there are possibilities that the triboelectrification properties of the toner particles may be lowered, that a photoconductor may be damaged, thereby deteriorating the transferring ability of the toner particles and that the inorganic fine particles separated from the toner particles may adhere to the photoconductor.

The inorganic fine particles greater in particle size are those having an average particle size of 30–500 nm, preferably 30–300 nm in terms of primary particles. If the inorganic fine particles greater in particle size may be used by themselves, the flowability of the toner particles can be surely retained because the organic fine particles are used in combination. It is however preferable to use them in combination with the inorganic fine particles smaller in particle size. If the average particle size of the inorganic fine particles of this kind is smaller than 30 nm, their polishing effect on the toner particles is lowered. If the average particle size is too great, they tend to separate from the toner particles, resulting in possibilities that the flowability of the toner particles may be lowered and that they may adhere to a photoconductor. The inorganic fine particles greater in particle size is used in a proportion of generally 0.1–5 parts by weight, preferably 0.2–4 parts by weight, more preferably 0.3–2 parts by weight per 100 parts by weight of the toner particles. If the proportion is too low, their polishing effect on the toner particles is lowered. If the proportion is too high on the contrary, there are possibilities that the tribo-electrification properties of the toner particles may be lowered, a photoconductor may be damaged, thereby deteriorating the transferring ability of the toner particles, and the inorganic fine particles separated from the toner particles may adhere to the photoconductor.

In the present invention, finely particulate silica is preferably used as the inorganic fine particles. Among others, colloidal silica (fine particulate silica prepared by the vapor phase process) is particularly preferred. The colloidal silica is preferably surface-treated with a hydrophobicity-imparting agent such as octylsilane, hexamethyldisilazane or dimethylsilane. It is more preferable to use, in combination, finely particulate silica having an average particle size of 30–500 nm, preferably 30–300 nm in terms of primary particles in a proportion of 0.1–5 parts by weight, preferably 0.2–4 parts by weight, more preferably 0.3–2 parts by weight and finely particulate silica having an average particle size of 5–20 nm, preferably 7–17 nm in terms of primary particles in a proportion of 0.1–5 parts by weight, preferably 0.2–4 parts by weight, more preferably 0.3–2 parts by weight.

When those smaller and greater in particle size are used as the inorganic fine particles in combination, good flowability is imparted to toner particles, and a proper polishing effect on a photoconductor is also provided when, for example, an organic photoconductor provided with a carrier transport layer (photoconductor layer) is used as the photoconductor, so that the occurrence of defective images or blank areas can be prevented.

Examples of the hydrophobicity-imparting agent used in the hydrophobicity-imparting treatment include, in addition to the above octylsilane, hexamethyldisilazane and dimethylsilane, octyltrimethoxysilane, silicone oil, octyltrichlorosilane, decyltrichlorosilane, nonyltrichlorosilane, (4-isopropylphenyl)trichlorosilane, (4-tert-butylphenyl)trichlorosilane, dipentyldichlorosilane, dihexyldichlorosilane, dioctyldichlorosilane, dinonyldichlorosilane, didecyldichlorosilane, didodecyldichlorosilane, (4-tert-butylphenyl) octyldichlorosilane, decenyldichlorosilane, dinonyldichlorosilane, di-2-ethylhexyl-dichlorosilane, di-3, 3-dimethylpentyldichlorosilane, trihexylchlorosilane, trioctylchlorosilane, tridecylchlorosilane, dioctylmethylchlorosilane, octyldimethylchlorosilane and (4-isopropylphenyl)diethylchlorosilane.

The hydrophobicity-imparting treatment may be performed by reacting the inorganic fine particles with at least one hydrophobicity-imparting agent at a high temperature in accordance with a method known per se in the art.

Toner particles:

No particular limitation is imposed on the toner particles used in the present invention, and any known colored particles comprising a binder resin, a colorant and other property-improving agents may be used.

Examples of the binder resin include styrene resins, acrylic resins, styrene-acrylic copolymers, styrene-butadiene copolymers, styrene-maleic anhydride copolymers, polyethylene, polypropylene, epoxy resins and polyester resins.

Examples of styrene monomers include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene/p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene.

Examples of acrylic monomers include acrylic acid, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methacrylic acid, methyl methacrylate, ethyl methacrylate, n-butyl methacrylate, isobutyl methacrylate, propyl methacrylate, n-octyl methacrylate, dodecyl methacrylate, lauryl methacrylate, 2-ethylhexyl methacrylate, stearyl methacrylate, 2-chloroethyl methacrylate, phenyl methacrylate, dimethylaminoethyl methacrylate, diethylaminoethyl methacrylate, acrylonitrile, methacrylonitrile, methacrylamide and acrylamide.

These monomers may be used either singly or in any combination thereof. Copolymers obtained by copolymerizing a styrene monomer, an methacrylic monomer and an acrylic monomer are particularly preferred as the binder resin.

Examples of the colorant include carbon black, nigrosine dyes, aniline black, Chalcoil Blue, chrome yellow, ultramarine blue, Du Pont Oil Red, Quinoline Yellow, Methylene Blue chloride, Phthalocyanine Blue, Malachite Green oxalate, lamp black and Rose Bengale.

Various additives such as paraffin and wax may be incorporated into the toner particles. For example, a polyolefin having a low softening point, paraffin wax having a high melting point, silicone varnish, a fatty acid ester or a partially saponified product thereof, a fatty acid amide compound, a higher alcohol, or the like may be added as an offset preventive. A metal complex dye, nigrosine dye, ammonium salt compound or the like may also be added as a charge control agent. Further, magnetic powder may be added to the toner particles if desired.

As a process for preparing the toner particles, there may be used any common process such as a process in which a binder resin prepared in advance by polymerization, and a colorant and other additives are melted and kneaded, and the thus-kneaded mixture is then ground and classified, or a process in which colored polymer particles (polymerization toner) containing a colorant and the like are prepared by suspension polymerization. Of these the polymerization toner obtained by the suspension polymerization process is particularly preferred because it can be provided as spherical particles even in particle size.

In order to prepare the toner particles by the suspension polymerization process, a composition containing at least a polymerizable monomer and a colorant is poured into an aqueous phase containing an inorganic dispersant, or an aqueous phase containing an inorganic dispersant and 0.00–0.1 wt. % of a surfactant, the resultant mixture is stirred by means of a high-shear stirrer to form minute droplets, and at this time, an oil-soluble initiator is mixed therein, and the resultant dispersion is then heated to polymerize the monomer. In order to enhance the dispersibility of the colorant in the polymerization toner, a dispersing agent with a polar group introduced into a part of its polymeric chain may be added in an amount about a half of the colorant to conduct the polymerization. Besides the colorant, a charge control agent, an offset preventive such as wax or a low molecular weight polyethylene or polypropylene, and/or the like may be mixed as needed to conduct the suspension polymerization.

The volume average particle size of the toner particles is generally 1–30 μm, preferably 2–20 μm, more preferably 3–10 μm. The reason why the average particle size of the toner particles are measured in terms of volume average particle size is that when the toner particles contain additives high in specific gravity, their weight average particle size may not reflect their actual average particle size in some cases. The volume average particle size of the toner particles is a value measured by the Coulter counter method. The toner particles used in the present invention are preferably spherical particles having a spheroidicity of at least 0.8. According to the suspension polymerization process, toner particles which are spherical and sharp in particle size distribution can be obtained with ease.

The developer according to the present invention is generally used as a non-magnetic one-component developer. However, it may also be used either as a magnetic one-component developer containing magnetic powder or as a two-component developer together with carrier particles. No particular limitation is imposed on the kinds of developing apparatus for electrophotography and photoconductor to which the developer according to the present invention may be applied, cleaning methods, and the like.

Developing apparatus:

Illustrated in FIG. 1 is a cross-sectional view of an example of an image-forming apparatus and a developing device, which are suitable for applying a developer according to the present invention. In this image-forming apparatus, a photoconductive drum 1, which is an image-bearing member, is installed rotatably in the direction of an arrow. The photoconductive drum 1 generally has a structure that a photoconductive layer (photoconductor) is provided around a peripheral surface of an electroconductive support drum. The photoconductive layer is composed of, for example, an organic photoconductor, selenium photoconductor, zinc oxide photoconductor or amorphous silicon photoconductor.

Around the photoconductive drum 1, a charging means 3, a latent image forming means 4, a developing means 5, a transfer means 6 and a cleaning means 2 are arranged along the circumferential direction of the drum. The charging means 3 bears an action that the surface of the photoconductive drum 1 is evenly charged either positively or negatively. Besides the charging roller illustrated in FIG. 1, for example, a corona discharge device, a charging blade or the like may be used. The latent image forming means 4 bears an action that light corresponding to image signals is applied on the predetermined pattern to the surface of the photoconductive drum evenly charged to form an electrostatic latent image on the exposed portion of the drum (reversal development system) or form an electrostatic latent image on the unexposed portion of the drum (normal development system). The latent image forming means 4 is composed of, for example, a combination of a laser device and an optical system, or a combination of an LED array and an optical system.

The developing means 5 bears an action that a developer (toner) is applied to the electrostatic latent image formed on the surface of the photoconductive drum 1. The developing means 5 is generally a developing device equipped with a development roller 8, a blade 9 for development roller, a receiving means (container casing) 11 for a developer 10 and a developer supply means (feed roller) 12. The development roller 8 is arranged in opposition to the photoconductive drum 1 and generally in close vicinity to the photoconductive drum 1 in such a manner that a part thereof comes into contact with the photoconductive drum 1, and is rotated in a direction opposite to the rotating direction of the photoconductive drum 1. The feed roller 12 is rotated in contact with and in the same direction as the development roller 8 to supply the toner 10 to the outer periphery of the development roller 8. When the development roller 8 is rotated in the developing device, the toner 10 within the developer receiving means 11 adheres to the peripheral surface of the development roller 8 owing to electrostatic force. The blade 9 for development roller comes into contact with the peripheral surface of the rotating development roller 8 to control the layer thickness of a toner layer formed on the peripheral surface of the development roller 8. Bias voltage is applied between the development roller 8 and the photoconductive drum 1 in such a manner that the toner is caused to adhere only to a light-exposed portion of the photoconductive drum 1 in a reversal development system, or only to a light-unexposed portion of the photoconductive drum 1 in a normal development system.

The transfer means 6 serves to transfer a toner image formed on the surface of the photoconductive drum 1 by the developing means 5 to a transfer material (transfer paper) 7. Besides the transfer roller illustrated in FIG. 1, for example, a corona discharge device, a transfer belt or the like may be used. The cleaning means 2 serves to clean off the toner remaining on the surface of the photoconductive drum 1 and is composed of, for example, a cleaning blade or the like. This cleaning means is not always required in the case of a system that cleaning action is conducted at the same time as development.

According to the present invention, there is thus provided a developing device equipped with a receiving means for containing a developer therein, a supply means for supplying the developer contained in the receiving means, and a developing means provided in opposition to an image-bearing member and adapted to develop an electrostatic latent image formed on the image-bearing member with the developer supplied by the supply means, wherein the receiving means contains the developer according to the present invention as a developer therein. According to the present invention, there is also provided an image-forming apparatus comprising the developing device and a transfer means for transferring an image developed with the developer to a transfer material.

Advantage of the Invention

According to the present invention, there is provided a developer which can stably retain its charge properties over a long period of time, does not increase the production of fog on a photoconductor and has excellent development durability. The developer according to the present invention comprises a finely particulate polymer capable of stably imparting charge properties to toner particles over a long period of time and hence exhibits stable flowability and charge properties over a long period of time. The developer according to the present invention is hard to damage any photoconductor, prevents the occurrence of a filming phenomenon on any photoconductor and also has excellent cleaning ability. The developer according to the present invention is suitable for use, in particular, as a non-magnetic one-component developer. According to the present invention, there are also provided a finely particulate polymer suitable for use as an abrasive for toner particles, and a preparation process thereof.

Embodiments of the Invention

The present invention will hereinafter be described more specifically by the following examples and comparative examples. However, the present invention is not limited to-these examples only.

The evaluation as to physical properties in the following examples and comparative examples was conducted in accordance with the following respective methods.

(1) Measuring method of image density:

The evaluation of the image density was conducted by measuring the image density of "a black solid area" by means of a Macbeth reflection densitometer.

(2) Measuring method of blow-off charge level:

The charge level of a finely particulate polymer sample was measured in the following manner. Namely, 59.7 g of a carrier (TEFV 150/250, product of Powdertec K.K.) and 0.3 g of the finely particulate polymer sample were weighed and placed into a 200-cc SUS-made pot. After rotating the pot for 30 minutes at a rate of 150 rpm to triboelectrify the polymer sample, the polymer sample was blown off under a nitrogen gas pressure of 1 $kg/cm^2$ in a blow-off meter manufactured by Toshiba Chemical Corporation, thereby measuring a charge level of the polymer sample.

(3) Determining method of fog on photoconductor:

Fogging toner particles on a photoconductor were collected by a transparent adhesive tape, and the tape was stuck on white paper to measure its reflectance Rf. On the other hand, only a transparent adhesive tape was stuck on white paper to measure its relfectance Rb. The respective reflectances were measured by means of a whiteness meter (NDW-1D manufactured by Nippon Denshoku Kogyo K.K.). The degree of fog (BG) on the photoconductor was determined in accordance with the following equation:

$$BG=Rb-Rf$$

(4) Measuring method of residual toner level after transfer (TR):

Toner particles remaining on a photoconductor after transfer were collected by a transparent adhesive tape, and the tape was stuck on white paper to measure its reflectance Rt. The reflectance was measured by means of a whiteness meter (NDW-1D manufactured by Nippon Denshoku Kogyo K.K.). A residual toner level after transfer (TR) was determined from a reflectance Rb measured by sticking only a transparent adhesive tape on white paper in accordance with the following equation:

$$TR=Rb-Rt$$

[EXAMPLE 1]

Finely Particulate Polymer A

A 3-liter four-necked flask equipped with a stirrer, a reflex condenser, a thermometer and a separatory funnel was charged with 2,000 g of deionized water, 20 g of styrene and 0.5 g of sodium styrenesulfonate, followed by stirring. After the resultant liquid mixture was then heated to 80° C., 300 g of a 1% solution of 2,2'-azobis[2-methyl-N-(2-hydroxyethyl)propionamide] were added into the flask through the separatory funnel to initiate a reaction. Twenty grams of deionized water were added to the separatory funnel to wash the separatory funnel. At a stage the reaction was continued for 7 hours, the conversion of the monomers to a polymer was determined by a gravimetric method and found to reach 98%. Then, 180 g of methyl methacrylate were charged into the separatory funnel and added dropwise to the liquid reaction mixture over 15 minutes. Thereafter, the reaction was continued for 3 hours. As a result, the conversion of the reaction was found to reach 97%. A finely particulate polymer of core-shell structure was thus obtained. The particle size of the finely particulate polymer was determined by a light-scattering method (LPA3000/3100 manufactured by Otsuka Denshi K.K.). As a result, its weight average particle size and number average particle size were 450 nm and 440 nm, respectively.

This finely particulate polymer was purified by ultrafiltration (UF Module ACV-3050 manufactured by Asahi Chemical Industry Co., Ltd.) until the electric conductivity of an aqueous phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer A of core-shell structure was prepared in the above-described manner. The blow-off charge level (Q/m) of Finely Particulate Polymer A was −520 [μc/g].

[EXAMPLE 2]

Finely Particulate Polymer B

A 3-liter four-necked flask equipped with a stirrer, a reflex condenser, a thermometer and a separatory funnel was charged with 2,000 g of deionized water, 60 g of styrene and 0.5 g of sodium styrenesulfonate, followed by stirring. After the resultant liquid mixture was then heated to 80° C., 300 g of a 1% solution of 2,2'-azobis[2-methyl-N-(2-hydroxyethyl)propionamide] were added into the flask through the separatory funnel to initiate a reaction. Twenty grams of deionized water were added to the separatory funnel to wash the separatory funnel. At a stage the reaction was continued for 7 hours, the conversion of the monomers to a polymer was determined by a gravimetric method and found to reach 97%. Then, 140 g of methyl methacrylate were charged into the separatory funnel and added dropwise to the liquid reaction mixture over 15 minutes. Thereafter, the reaction was continued for 3 hours. As a result, the conversion of the reaction was found to reach 97%. A finely particulate polymer of core-shell structure was thus obtained. The particle size of the finely particulate polymer was determined by a light-scattering method (LPA3000/3100 manufactured by Otsuka Denshi K.K.). As a result, its weight average particle size and number average particle size were 440 nm and 430 nm, respectively.

This finely particulate polymer was purified .by ultrafiltration (UF Module ACV-3050 manufactured by Asahi Chemical Industry Co., Ltd.) until the electric conductivity of an aqueous phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer B of core-shell structure was prepared in the above-described manner. The blow-off charge level of Finely Particulate Polymer B was −450 [μc/g].

[EXAMPLE 3]

Finely Particulate Polymer C

A 3-liter four-necked flask equipped with a stirrer, a reflex condenser, a thermometer and a separatory funnel was charged with 2,000 g of deionized water, 100 g of styrene and 0.5 g of sodium styrenesulfonate, followed by stirring. After the resultant liquid mixture was then heated to 80° C., 300 g of a 1% solution of 2,2'-azobis[2-methyl-N-(2-hydroxyethyl)propionamide] were added into the flask through the separatory funnel to initiate a reaction. Twenty grams of deionized water were added to the separatory funnel to wash the separatory funnel. At a stage the reaction was continued for 7 hours, the conversion of the monomers to a polymer was determined by a gravimetric method and found to reach 96%. Then, 100 g of methyl methacrylate were charged into the separatory funnel and added dropwise to the liquid reaction mixture over 15 minutes. Thereafter, the reaction was continued for 3 hours. As a result, the conversion of the reaction was found to reach 97%. A finely particulate polymer of core-shell structure was thus obtained. The particle size of the finely particulate polymer was determined by a light-scattering method (LPA3000/3100 manufactured by Otsuka Denshi K.K.). As a result, its weight average particle size and number average particle size were 470 nm and 460 nm, respectively.

This finely particulate polymer was purified by ultrafiltration (UF Module ACV-3050 manufactured by Asahi Chemical Industry Co., Ltd.) until the electric conductivity of an aqueous phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer C of core-shell structure was prepared in the above-described manner. The blow-off charge level of Finely Particulate Polymer C was −490 [μc/g].

[Comparative Example 1]

Finely Particulate Polymer D

A 3-liter four-necked flask equipped with a stirrer, a reflex condenser, a thermometer and a separatory funnel was charged with 2,000 g of deionized water and 200 g of styrene, followed by stirring. After the resultant liquid mixture was then heated to 80° C., 100 g of a 1% solution of potassium persulfate (product of Wako Pure Chemical Industries, Ltd.) were added into the flask through the separatory funnel to initiate a reaction. At a stage the reaction was continued for 7 hours, the conversion of the monomer to a polymer was determined by a gravimetric method and found to reach 98%. The particle size of the finely particulate polymer thus obtained was determined by a light-scattering method (LPA3000/3100 manufactured by Otsuka Denshi K.K.). As a result, its weight average particle size and number average particle size were 460 nm and 420 nm, respectively.

This finely particulate polymer was purified by ultrafiltration (UF Module ACV-3050 manufactured by Asahi Chemical Industry Co., Ltd.) until the electric conductivity of an aqueous-phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer D composed of polystyrene was prepared in the above-described manner. The blow-off charge level of Finely Particulate Polymer D was −80 [μc/g].

[Comparative Example 2]

Finely Particulate Polymer E

A 3-liter four-necked flask equipped with a stirrer, a reflex condenser, a thermometer and a separatory funnel was charged with 2,000 g of deionized water and 200 g of methyl methacrylate, followed by stirring. After the resultant liquid mixture was then heated to 80° C., 100 g of a 1% solution of potassium persulfate (product of Wako Pure Chemical Industries, Ltd.) were added into the flask through the separatory funnel to initiate a reaction. At a stage the reaction was continued for 7 hours, the conversion of the monomer to a polymer was determined by a gravimetric method and found to reach 98%. The particle size of the finely particulate polymer thus obtained was determined by a light-scattering method (LPA3000/3100 manufactured by Otsuka Denshi K.K.). As a result, its weight average particle size and number average particle size were 410 nm and 400 nm, respectively.

This finely particulate polymer was purified by ultrafiltration (UF Module ACV-3050 manufactured by Asahi Chemical Industry Co., Ltd.) until the electric conductivity of an aqueous phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer E composed of polymethyl methacrylate was prepared in the above-described manner. The blow-off charge level of Finely Particulate Polymer E was −200 [μc/g].

[Comparative Example 3]

Finely Particulate Polymer F

A 3-liter four-necked flask equipped with a stirrer, a reflex condenser, a thermometer and a separatory funnel was charged with 2,000 g of deionized water, 20 g of styrene and 180 g of methyl methacrylate, followed by stirring. After the resultant liquid mixture was then heated to 80° C., 100 g of a 1% solution of potassium persulfate (product of Wako Pure Chemical Industries, Ltd.) were added into the flask through the separatory funnel to initiate a reaction. At a stage the reaction was continued for 7 hours, the conversion of the monomers to a polymer was determined by a gravimetric method and found to reach 98%. The particle size of the finely particulate polymer thus obtained was determined by a light-scattering method (LPA3000/3100 manufactured by Otsuka Denshi K.K.). As a result, its weight average particle size and number average particle size were 440 nm and 420 nm, respectively.

This finely particulate polymer was purified by ultrafiltration (UF Module ACV-3050 manufactured by Asahi Chemical Industry Co., Ltd.) until the electric conductivity of an aqueous phase reached 50 μS. Thereafter, water was evaporated from the purified polymer by a rotary evaporator, and the polymer was then dried for 24 hours in a vacuum dryer controlled at 50° C. The finely particulate polymer thus dried was then ground in a mortar to primary particles. Finely Particulate Polymer F was prepared in the above-described manner. The blow-off charge level of Finely Particulate Polymer F was −140 [μc/g].

[EXAMPLE 4]

Preparation Example 1 of developer

<Preparation of toner>

Dispersed in a ball mill at room temperature were 70 parts by weight of styrene, 30 parts by weight of butyl methacrylate, 8 parts by weight of carbon black ("Printex 150T", trade name, product of Degussa AG), 0.5 part by weight of a Cr dye ("Bontron S-34", trade name, product of Orient Chemical Industries, Ltd.) and 2 parts by weight of 2,2'-azobis-(2,4-dimethylvaleronitrile), thereby obtaining an intimate liquid mixture. The liquid mixture was added into 350 parts by weight of distilled water with 5 parts by weight of calcium phosphate finely dispersed therein to obtain a dispersion.

The dispersion was subjected to high-shear agitation by a rotor-stator type homomixer under conditions of at least pH 9 to disperse the liquid mixture containing the monomers in the form of minute droplets in an aqueous phase. This aqueous dispersion was then charged in a 1-liter four-necked flask equipped with a stirrer, a thermometer, a nitrogen inlet tube and a reflux condenser to polymerize the monomers under stirring for 4 hours at 65° C. After the thus-obtained polymer dispersion was thoroughly washed with an acid and then water, the resultant polymer was separated and dried, thereby obtaining toner particles which were colored polymer particles.

The volume-average particle size of the thus-obtained toner particles was 6.8 μm as measured by the Coulter counter method (Coulter Counter TA-II manufactured by, Coulter Co.).

<Preparation of developer>

Added to 100 parts by weight of the toner particles prepared above were 0.3 part by weight of Finely Particulate Polymer A of core-shell structure prepared in Example 1 and 1.0 part by weight of finely particulate silica (average particle size =45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints remained good from the beginning, thereby obtaining good results.

[EXAMPLE 5]

Preparation Example 2 of developer

<Preparation of developer>

Added to 100 parts by weight of the toner particles obtained in Example 4 were 0.3 part by weight of Finely Particulate Polymer B of core-shell structure prepared in Example 2 and 1.0 part by weight of finely particulate silica (average particle size=45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints remained good from the beginning, thereby obtaining good results.

[EXAMPLE 6]

Preparation Example 3 of developer

<Preparation of developer>

Added to 100 parts by weight of the toner particles obtained in Example 4 were 0.3 part by weight of Finely Particulate Polymer C of core-shell structure prepared in Example 3 and 1.0 part by weight of finely particulate silica (average particle size=45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints remained good from the beginning, thereby obtaining good results.

[Comparative Example 4]

Preparation Example 4 of developer

<Preparation of developer>

Added to 100 parts by weight of the toner particles obtained in Example 4 were 0.3 part by weight of Finely Particulate Polymer D prepared in Comparative Example 1 and 1.0 part by weight of finely particulate silica (average particle size=45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, fog on a photosensitive member was observed to a great extent from the beginning, and the fog further increased as printing was conducted repeatedly. The developer was hence unfit for service.

[Comparative Example 5]

Preparation Example 5 of developer

<Preparation of developer>

Added to 100 parts by weight of the toner particles obtained in Example 4 were 0.3 part by weight of Finely Particulate Polymer E prepared in Comparative Example 2 and 1.0 part by weight of finely particulate silica (average particle size=45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints was good at first, while fog gradually increased as printing was conducted repeatedly.

[Comparative Example 6]

Preparation Example 6 of developer

<Preparation of developer>

Added to 100 parts by weight of the toner particles obtained in Example 4 were 0.3 part by weight of Finely Particulate Polymer F prepared in Comparative Example 3 and 1.0 part by weight of finely particulate silica (average particle size=45 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, fog on a photosensitive member was observed to a great extent from the beginning, and the fog further increased as printing was conducted repeatedly. The developer was hence unfit for service.

The above results are shown collectively in Table 1.

TABLE 1

| | Finely particulate polymer | | Properties of developer | | | |
|---|---|---|---|---|---|---|
| | | | Image density (ID) | | Fog on photo sensitive member | |
| | Composition | Blow-off charge level [μc/g] | First | After 20,000 copies | First | After 20,000 copies |
| Ex. 4 | A: Core (PS)/shell (PMMA) 10/90 | −520 | 1.35 | 1.35 | 6 | 8 |
| Ex. 5 | B: Core (PS)/shell (PMMA) 30/70 | −450 | 1.36 | 1.34 | 8 | 9 |
| Ex. 6 | C: Core (PS)/shell (pMMA) 50/50 | −490 | 1.37 | 1.35 | 7 | 8 |
| Comp. Ex. 4 | D: PS | −80 | 1.35 | 1.34 | 13 | 28 |
| Comp. Ex. 5 | E: PMMA | −200 | 1.34 | 1.33 | 8 | 15 |
| Comp. Ex. 6 | F: St/MMA copolymer 10/90 | −140 | 1.35 | 1.35 | 9 | 26 |

[EXAMPLE 7]

Preparation Example 7 of developer

<Preparation of developer>

Added to 100 parts by weight of the toner particles obtained in Example 4 were 0.3 part by weight of Finely Particulate Polymer A of a core-shell structure prepared in Example 1 and 1.0 part by weight of finely particulate silica (average particle size=15 nm in terms of primary particles) subjected to a hydrophobicity-imparting treatment with hexamethyldisilazane (hereinafter may be abbreviated as "HMDS"). The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints was good at the initial stage, and fairly good even after printing of 20,000 copies.

[EXAMPLE 8]

Preparation Example 8 of developer

<Preparation of developer>

Added to 100 parts by weight of the toner particles obtained in Example 4 were 0.3 part by weight of Finely Particulate Polymer A of a core-shell structure prepared in Example 1 and 1.0 part by weight of finely particulate silica (average particle size=40 nm in terms of primary particles) subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the quality of the resultant prints was good at the initial stage, and fairly good even after printing of 20,000 copies.

[EXAMPLE 9]

Preparation Example 9 of developer

<Preparation of developer>

Added to 100 parts by weight of the toner particles obtained in Example 4 were 0.3 part by weight of Finely Particulate Polymer A of a core-shell structure prepared in Example 1, 0.5 part by weight of finely particulate silica having an average particle size of 15 nm in terms of primary particles subjected to a hydrophobicity-imparting treatment with hexamethyldisilazane and 0.5 part by weight of finely particulate silica having an average particle size of 40 nm in terms of primary particles subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the print quality of the initial stage was retained even after printing of 20,000 copies, thereby obtaining good results. When conducting printing under circumstances of 30° C. and 80% humidity (HH circumstances) and under circumstances of 10° C. and 20% humidity (LL circumstances), print quality was good in both cases.

[EXAMPLE 10]

Preparation Example 10 of developer

<Preparation of developer>

Added to 100 parts by weight of the toner particles obtained in Example 4 were 0.3 part by weight of Finely Particulate Polymer A of a core-shell structure prepared in Example 1, 0.5 part by weight of finely particulate silica having an average particle size of 15 nm in terms of primary particles subjected to a hydrophobicity-imparting treatment with octylsilane and 0.5 part by weight of finely particulate silica having an average particle size of 40 nm in terms of primary particles subjected to a hydrophobicity-imparting treatment with octylsilane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the print quality of the initial stage was retained even after printing of 20,000 copies, thereby obtaining good results. When conducting printing under circumstances of 30° C. and 80% humidity (HH circumstances) and under circumstances of 10° C. and 20% humidity (LL circumstances), print quality was good in both cases.

[EXAMPLE 11]

Preparation Example 11 of developer

<Preparation of developer>

Added to 100 parts by weight of the toner particles obtained in Example 4 were 0.3 part by weight of Finely Particulate Polymer A of a core-shell structure prepared in Example 1, 0.5 part by weight of finely particulate silica having an average particle size of 15 nm in terms of primary particles subjected to a hydrophobicity-imparting treatment with dimethylsilane and 0.5 part by weight of finely particulate silica having an average particle size of 40 nm in terms of primary particles subjected to a hydrophobicity-imparting treatment with dimethylsilane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the print quality of the initial stage was retained even after printing of 20,000 copies, thereby obtaining good results. When conducting printing under circumstances of 30° C. and 80% humidity (HH circumstances) and under circumstances of 10° C. and 20% humidity (LL circumstances), print quality was good in both cases.

[EXAMPLE 12]

Preparation Example 12 of developer

<Preparation of developer>

Added to 100 parts by weight of the toner particles obtained in Example 4 were 0.3 part by weight of Finely Particulate Polymer B of a core-shell structure prepared in Example 2, 0.5 part by weight of finely particulate silica having an average particle size of 15 nm in terms of primary particles subjected to a hydrophobicity-imparting treatment with hexamethyldisilazane and 0.5 part by weight of finely particulate silica having an average particle size of 40 nm in terms of primary particles subjected to a hydrophobicity-imparting treatment with hexamethyldisilazane. The resultant mixture was mixed by means of a Henschel mixer, thereby obtaining a developer.

<Evaluation>

Using the developer obtained above, printing of 20,000 copies was conducted by a commercially-available printer of an electrophotographic system. As a result, the print quality of the initial stage was retained even after printing of 20,000 copies, thereby obtaining good results. When conducting printing under circumstances of 30° C. and 80% humidity (HH circumstances) and under circumstances of 10° C. and 20% humidity (LL circumstances), print quality was good in both cases.

[Comparative Example 7]

Preparation Example 13 of developer

Added to 100 parts by weight of the toner particles obtained in Example 4 were 0.5 part by weight of finely particulate silica having an average particle size of 15 nm in terms of primary particles subjected to a hydrophobicity-imparting treatment with hexamethyldisilazane and 0.5 part by weight of finely particulate silica having an average particle size of 40 nm in terms of primary particles subjected to a hydrophobicity-imparting treatment with hexamethyldisilazane. The resultant mixture was mixed by means of a Henschel mixer, thereby obtaining a developer.

<Evaluation>

Using the developer obtained above, printing was conducted by a commercially-available printer of an electrophotographic system. As a result, fog was greatly produced, and print quality was poor. The developer was hence unfit for service. Besides, fog was greatly produced, and a residual toner level after transfer (TR) on a photosensitive member was high when conducting printing both under circumstances of 30° C. and 80% humidity (HH circumstances) and under circumstances of 10° C. and 20% humidity (LL circumstances).

These results are shown collectively in Table 2.

TABLE 2

| | | Example 7 | Example 8 | Example 9 | Example 10 | Example 11 | Example 12 | Comparative Example 7 |
|---|---|---|---|---|---|---|---|---|
| Silica of 15 nm | Surface treatment | HMDS | — | HMDS | OS | DMS | HMDS | HMDS |
| | Amount added | 1.0 | — | 0.5 | 0.5 | 0.5 | 0.5 | 0.5 |
| Silica of 40 nm | Surface treatment | — | HMDS | HMDS | OS | DMS | HMDS | HMDS |
| | Amount added | — | 1.0 | 0.5 | 0.5 | 0.5 | 0.5 | 0.5 |
| Finely particulate polymer A: Amount added | | 0.3 | 0.3 | 0.3 | 0.3 | 0.3 | — | — |
| Finely particulate polymer B: Amount added | | — | — | — | — | — | 0.3 | — |
| First | ID | 1.46 | 1.35 | 1.45 | 1.44 | 1.43 | 1.44 | 1.45 |
| | Fog | 5 | 6 | 2 | 2 | 2 | 2 | 15 |
| | TR | 3 | 5 | 4 | 4 | 4 | 4 | 5 |
| After 20,000 copies | ID | 1.35 | 1.30 | 1.45 | 1.43 | 1.40 | 1.44 | 1.41 |
| | Fog | 5 | 7 | 3 | 4 | 5 | 4 | 30 |
| | TR | 10 | 13 | 8 | 7 | 9 | 8 | 8 |
| HH circumstances 30° C., 80% PH | ID | 1.41 | 1.36 | 1.43 | 1.42 | 1.38 | 1.42 | 1.39 |
| | Fog | 4 | 5 | 4 | 3 | 10 | 4 | 25 |
| | TR | 5 | 6 | 7 | 7 | 7 | 7 | 37 |
| LL circutstances 10° C., 20% RH | ID | 1.45 | 1.37 | 1.45 | 1.45 | 1.44 | 1.43 | 1.42 |
| | Fog | 3 | 4 | 2 | 1 | 2 | 3 | 20 |
| | TR | 7 | 8 | 8 | 9 | 12 | 8 | 28 |

HMDS: Hexamethydisilazane; OS: Octylsilane; DMS: Dimethylsilane.

We claim:

1. A developer comprising toner particles and particles of a polymer having a weight average particle size of from 0.005–5 μm and a core-shell structure, wherein the core is formed of a vinyl aromatic hydrocarbon polymer and the shell is formed of a (meth)acrylic ester polymer, wherein the weight ratio of the core to the shell is from 5:95 to 95:5, said polymer having been obtained by a soap-free emulsion polymerization process.

2. The developer according to claim 1, wherein the weight average particle size of the finely particulate polymer is smaller than the volume average particle size of the toner particles.

3. The developer according to claim 1, which comprises of 0.01–10 parts by weight of the finely divided particulate polymer per 100 parts by weight of the toner particles.

4. The developer according to claim 1, wherein the core part of the finely particulate polymer is obtained by copolymerizing a vinyl aromatic hydrocarbon monomer with at least one styrenesulfonic acid salt selected from the group consisting of sodium styrenesulfonate and potassium styrenesulfonate.

5. The developer according to claim 4, wherein the core part of the finely particulate polymer is obtained by copolymerizing the vinyl aromatic hydrocarbon monomer with the styrenesulfonic acid salt using a water-soluble azo compound as a radical initiator.

6. The developer according to claim 4, wherein 0.01–20 parts by weight of the styrene sulfonic acid salt is used per 100 parts by weight of the vinyl aromatic hydrocarbon monomer.

7. The developer according to claim 1, which further comprises inorganic fine particles.

8. The developer according to claim 7, wherein the inorganic fine particles have an average particle size ranging from 5 to 500 nm in terms of primary particles.

9. The developer according to claim 8, wherein the inorganic fine particles have an average particle size ranging from 5 to 20 nm in terms of primary particles.

10. The developer according to claim 8, wherein the inorganic fine particles have an average particle size ranging from 30 to 500 nm in terms of primary particles.

11. The developer according to claim 7, wherein the inorganic fine particles are composed of inorganic fine particles having an average particle size ranging from 5 to 20 nm in terms of primary particles, and inorganic fine particles having an average particle size ranging from 30 to 500 nm in terms of primary particles.

12. The developer according to claim 7, wherein the surfaces of the inorganic fine particles are made hydrophobic.

13. The developer according to claim 12, wherein the surfaces of the inorganic free particles are made hydrophobic by treatment with hexamethyldisilazane or acetylsilane.

14. The developer according to claim 11, wherein the inorganic fine particles having an average particle size ranging from 5 to 20 nm in terms of primary particles, and the inorganic fine particles having an average particle size ranging from 30 to 500 nm in terms of primary particles are mixed in proportions of 0.1–5 parts by weight and 0.1–5 parts by weight, respectively, per 100 parts by weight of the toner particles.

15. The developer according to claim 7, wherein the inorganic fine particles are silica.

16. The developer according to claim 4, which comprises 0.2–10 parts by weight of the inorganic fine particles per 100 parts by weight of the toner particles.

17. The developer according to claim 1, wherein the volume average particle size of the toner particles falls within a range of 1–30 μm.

18. The developer according to claim 1, wherein the toner particles are spherical particles having a spheroidicity of at least 0.8.

19. The developer according to claim 1, wherein the charging polarity of the toner particles is negative.

20. The developer according to claim 1, wherein the toner particles are colored polymer particles obtained by suspension-polymerizing a monomer composition comprising at least polymerizable monomers and a colorant.

* * * * *